US007484321B1

(12) United States Patent
Stafne, Sr.

(10) Patent No.: US 7,484,321 B1
(45) Date of Patent: Feb. 3, 2009

(54) ANTI-FREEZE BACKHOE BUCKET INSERT

(76) Inventor: John D. Stafne, Sr., 35422 Hinckley Rd., Hinckley, MN (US) 55037

( * ) Notice: Subject to any disclaimer, the term of this patent is extended or adjusted under 35 U.S.C. 154(b) by 0 days.

(21) Appl. No.: 11/891,121

(22) Filed: Aug. 9, 2007

Related U.S. Application Data

(60) Provisional application No. 60/836,348, filed on Aug. 9, 2006.

(51) Int. Cl.
*E02F 5/30* (2006.01)

(52) U.S. Cl. ..... 37/227; 37/444

(58) Field of Classification Search ..... 37/196, 37/199, 200, 226, 227, 228, 444
See application file for complete search history.

(56) References Cited

U.S. PATENT DOCUMENTS

| | | | | | |
|---|---|---|---|---|---|
| 250,164 | A * | 11/1881 | Osborne | 37/200 |
| 1,127,407 | A * | 2/1915 | Clayborne | 37/200 |
| 1,127,497 | A | 2/1915 | Clayborne | |
| 1,340,263 | A * | 5/1920 | Berry | 37/200 |
| 1,376,741 | A * | 5/1921 | Boyle | 37/200 |
| 2,086,469 | A | 7/1937 | Bullard | |
| 3,824,718 | A | 7/1974 | Nekrasov et al. | |
| 4,033,055 | A | 7/1977 | Lazarecky | |
| 4,034,489 | A | 7/1977 | Hughes, Jr. | |
| 4,129,952 | A | 12/1978 | Olson | |
| 5,515,623 | A | 5/1996 | Weeks | |
| 6,003,916 | A * | 12/1999 | Chalmers | 294/54.5 |
| 6,128,838 | A | 10/2000 | Morlock | |
| 6,318,007 | B1 | 11/2001 | Morlock | |
| 2007/0169385 | A1 * | 7/2007 | Brisebois | 37/444 |

* cited by examiner

*Primary Examiner*—Gary S Hartmann
(74) *Attorney, Agent, or Firm*—Robert C. Montgomery

(57) ABSTRACT

A steel insert apparatus for a backhoe bucket having an integral heating system to defrost construction equipment in cold weather is herein disclosed. The apparatus is intended for use on backhoes, front end loaders, bulldozers, and other similar equipment with a blade or a bucket. When required by cold weather, a conventional blade or bucket will have the apparatus inserted snuggly into the bucket. The insert contains a series of interconnected heating tubes along its inner surfaces. The heating tubes are connected to an input and output connection on each end which allows engine coolant to be circulated through the heating tubes by means of flexible hoses and fittings providing heat to the insert. Such a feature allows the construction equipment to be used in cold weather without being affected by ice or snow build-up.

13 Claims, 7 Drawing Sheets

ANTI-FREEZE BACKHOE BUCKET INSERT

RELATED APPLICATIONS

The present invention was first described in and claims the benefit of U.S. Provisional Application No. 60/836,348, filed Aug. 9, 2006, the entire disclosures of which are incorporated herein by reference.

FIELD OF THE INVENTION

This invention relates to a heating apparatus for construction equipment and, more particularly, to an anti-freeze backhoe bucket apparatus for defrosting construction equipment during cold weather.

BACKGROUND OF THE INVENTION

Regardless of cold weather conditions, construction equipment such as front end loaders, back hoes, bulldozers and the like are expected to perform its tasks. While block heaters, low-temperature lubricants and the like help their engines run more reliably, the actual business end of the unit such as the blade or bucket is very prone to having the moved material freeze up or cake in or on the bucket or blade respectively. This results in lost time in removing such buildup. Further, inaccurate volume measurements during loading or unloading procedures are another negative factor. Accordingly, there exists a need for a means by which construction equipment can be used in cold weather environments without the disadvantages ad described above. The development of the invention herein described fulfills this need.

Several attempts have been made in the past to provide an apparatus for defrosting construction equipment during cold weather. U.S. Pat. No. 4,034,489 in the name of Hughes discloses a shovel having an electric heating element affixed to the blade portion thereof. A rechargeable battery is utilized to provide energizing power to the heating element. The rechargeable battery, as well as the heating element, may be energized by utilizing a power cord adapted to flexibly convey household utility current to the apparatus. The handle portion of the shovel is exposed to some of the heat generated by the heating element thereby providing additional comfort to the user. Unfortunately, this prior art example does not assist a user to defrost construction equipment.

U.S. Pat. No. 6,128,838 in the name of Morlock discloses a heated bucket system for significantly reducing the accumulation of frozen mud and ice within a bucket, thereby maintaining the bucket's dirt moving capacity. The inventive device includes a bucket attachable to an arm of a backhoe or other machinery, a pump attached to the coolant system of the backhoe, an inflow tube fluidly connected to the pump, a heat tube attached to the back member of the bucket preferably in a sinusoidal pattern and fluidly connected to the inflow tube, and an outflow tube fluidly connected to the heat tube opposite of the inflow tube and fluidly connected to the coolant system of the backhoe. In operation, the pump draws the heated coolant within the coolant system and pumps it through the heat tube attached to the bucket. The heat from within the coolant is exchanged with the bucket thereby maintaining the temperature of the bucket above freezing. The coolant is then returned to the coolant system through an outflow tube. The heated bucket prevents the mud and water from freezing within the bucket during operation, thereby maintaining the earth moving capacity of the backhoe in cold weather conditions. The invention also operates to maintain earth moving capacity during warm weather conditions by preventing the accumulation of mud and sticky dirt. Unfortunately, this prior art example does not assist a user to defrost other construction equipment during freezing temperatures.

U.S. Pat. No. 5,515,623 in the name of Weeks describes a road and/or airport runway scraping blade for use with a ground supported vehicle. The scraping blade includes a frame for attaching the scraping blade to the vehicle. The scraping blade has a front facing side, a rearward facing side, a top edge and a bottom edge. Both edges extend laterally of a longitudinal axis of the vehicle when coupled to the vehicle. A coupling structure is provided for facilitating a coupling of the frame to the vehicle with the rearward facing side facing the rear of the vehicle. An elongated conduit and a fastening structure is provided for fastening the conduit to the rearward facing side of the blade intermediate the coupling structure and the bottom edge of the blade. A longitudinal axis of the conduit extends generally parallel to the lower edge. A plurality of laterally spaced spray nozzles are provided and are oriented along a length of the conduit and communicating with an interior of the conduit. The spray nozzles are directed downwardly away from the coupling structure and toward the ground so that a liquid supplied to the interior of the conduit will be sprayed onto the ground in a region immediately behind the lower edge. Unfortunately, this prior art example does not assist a user to defrost construction equipment.

None of the prior art particularly describes an anti-freeze backhoe bucket. Accordingly, there is a need for such an invention. The present invention satisfies such a need by providing an apparatus that is convenient and easy to use, lightweight yet durable in design, and designed for defrosting construction equipment during cold weather.

SUMMARY OF THE INVENTION

In view of the foregoing disadvantages inherent in the prior art, it has been observed that there is need for an anti-freeze apparatus for construction equipment with an integral heating mechanism to aid in operation in cold weather climates.

The invention is intended for use on backhoes, front end loaders, bulldozers, and other similar equipment with blade or bucket construction. It can be seen that in lieu of a conventional blade or bucket, the invention is equipped with an insert that fits snuggly in or on the main bucket or blade. The insert contains a series of channels along all of its surfaces that are interconnected in a loop fashion. The channel is connected to an input and output connection on each end which allows engine coolant to be routed through it via a series of flexible hoses. Such a feature allows the construction equipment to be used in cold weather, including ice or snow to reduce or eliminate the buildup or freezing of material in the bucket or on the blade. The use of the anti-freeze bucket apparatus provides for adaptive use on all types of construction equipment in cold weather conditions in an efficient manner.

An anti-freeze backhoe bucket apparatus includes a housing removably seated within an existing bucket of the construction equipment. Such a housing includes monolithically formed sidewalls, a back wall and a floor. The apparatus further includes a plurality of heating elements seated within the housing. Such heating elements are affixed to inner surfaces of the housing to thereby form a singular fluid path in a serpentine pattern. The heating elements have a singular and continuous body provided with a serpentine configuration with straight segments spanning across a core of the housing and further with a plurality of peaks and dips in proximity to a rim of the housing.

The heating elements span across a substantial portion of the back wall, the side walls, and the floor of the housing for providing optimum heat distribution. The heating elements are formed from non-corrosive and durable material. The heating elements are selected from a group of heating elements including: a plurality of heating tubes, a plurality of interconnected heating plates, a plurality of heating ports embedded within the housing and any combination thereof. Inlet and outlet hoses are in fluid communication with the fluid hoses and the heating elements respectively. Such inlet and outlet hoses cooperate with the pumping system to thereby introduce heated fluid into the heating elements and subsequently direct cooled fluid from the heating elements back to the pumping system to be reheated.

The apparatus further includes a closed loop pumping system including a plurality of fluid hoses coupled thereto. Such a pumping system supplies a volume of heating fluid to the heating elements and includes a pair of control valves coupled directly to the fluid hoses for controlling a flow rate of the heated and cooled fluids respectively. The pumping system further includes a pump attached to the fluid hoses, a reservoir in fluid communication with the pump, and a heating coil seated within the reservoir.

A method for heating a bucket of an existing construction equipment machine includes the steps of: inserting a housing within the bucket such that corresponding walls and floors of the housing and bucket are abutted against one another respectively; fastening the housing within the bucket; positioning at least one heating element within the housing; mounting a pumping system to a desired body panel of the bucket; wiring the pumping system to an existing vehicle electrical system; attaching the heating elements to inlet and outlet tubes exiting from the housing; attaching fluid hoses to the inlet and outlet tubes respectively; routing the fluid hoses from the inlet and outlet tubes to corresponding ports of the pump system; and propelling heated fluid from the pumping system through the fluid hoses and the inlet tube and through the heating elements such that cooled fluid is channeled out from the outlet tube and back through the outlet tube and the fluid hoses to the pumping system to be reheated using the pumping system.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | anti-freeze backhoe bucket insert |
| 20 | inlet tube |
| 21 | outlet tube |
| 22 | fluid hose |
| 23 | mounting block |
| 25 | bucket penetration |
| 31 | side panel |
| 32 | back panel |
| 33 | floor panel |
| 40 | heating tubes |
| 45 | internal cooling port embodiment |
| 46 | heating ports |
| 50 | bucket |
| 60 | external cooling plate embodiment |
| 61 | heating plate |
| 100 | attachment |
| 110 | fastener |
| 200 | pumping system |
| 205 | control valve |
| 210 | reservoir |
| 215 | reservoir mount |
| 220 | heating coil |
| 225 | pump |
| 230 | power cord |
| 240 | fluid |

DETAILED DESCRIPTION OF THE PREFERRED EMBODIMENT

Figure 1:
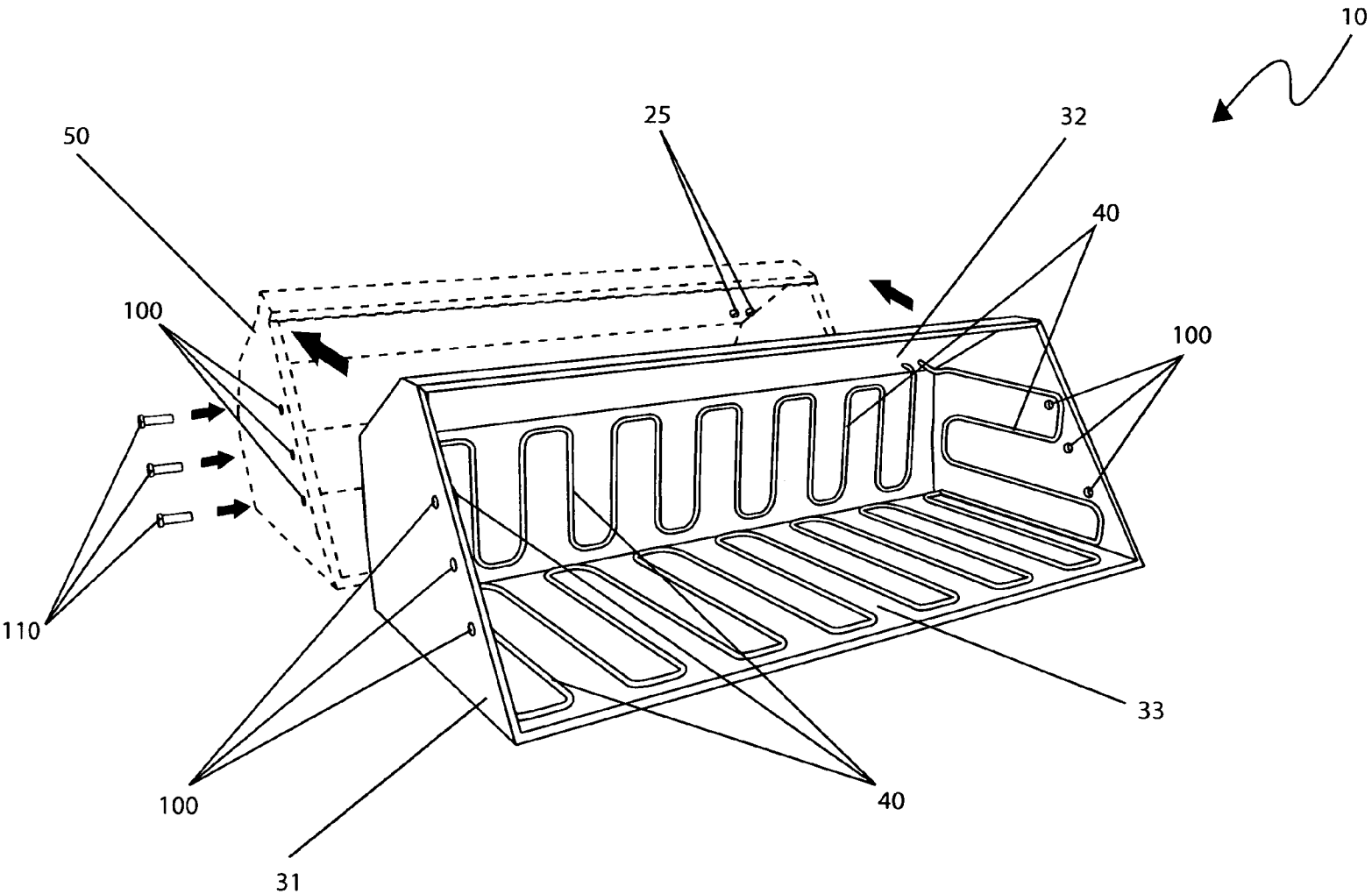
FIG. 1 is an environmental view of an anti-freeze backhoe bucket insert 10, according to a preferred embodiment of the present invention.
Figure 2A:
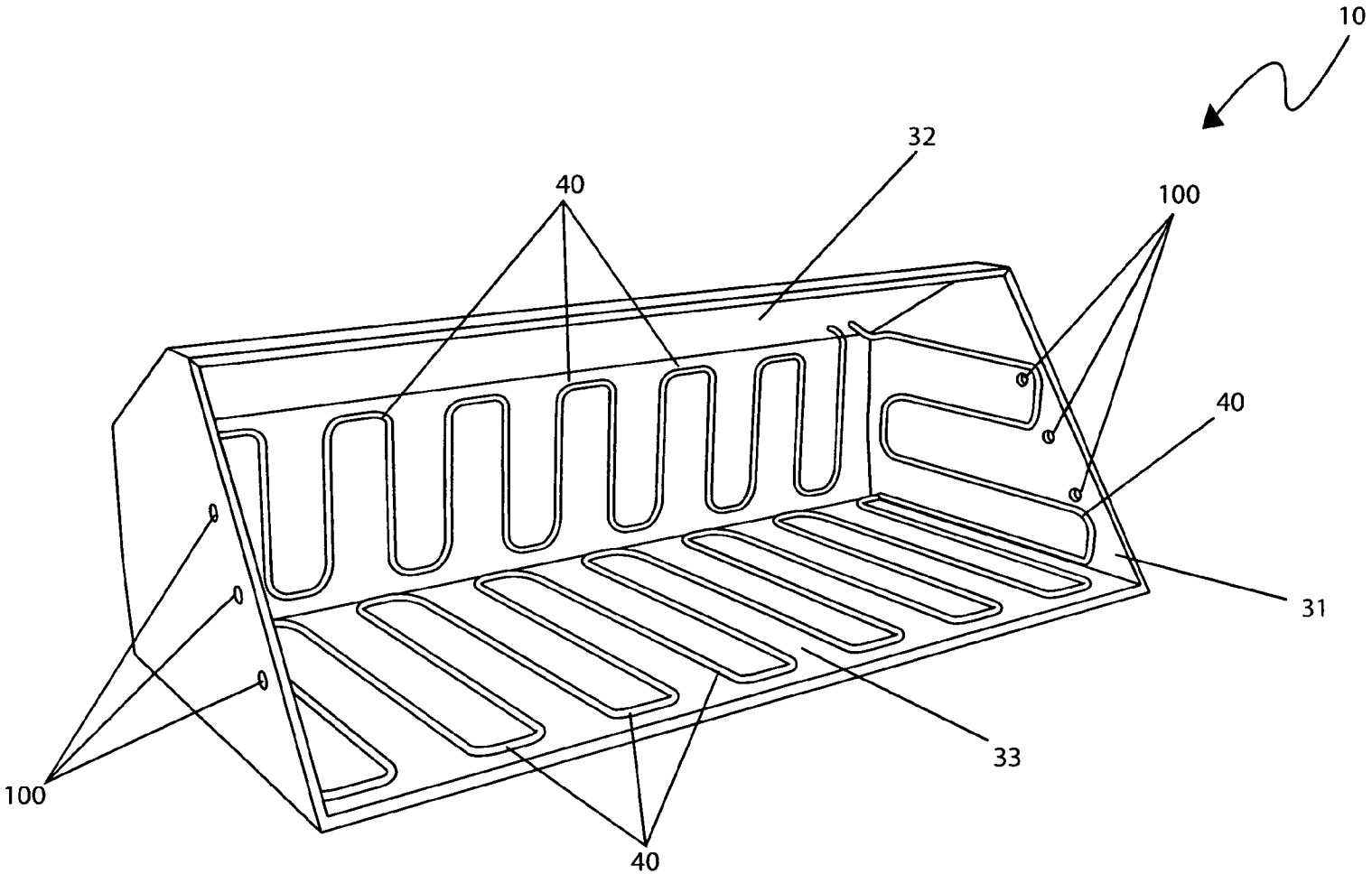
FIG. 2*a* is a front perspective view of the anti-freeze backhoe bucket insert 10, according to a preferred embodiment of the present invention.
Figure 2B:
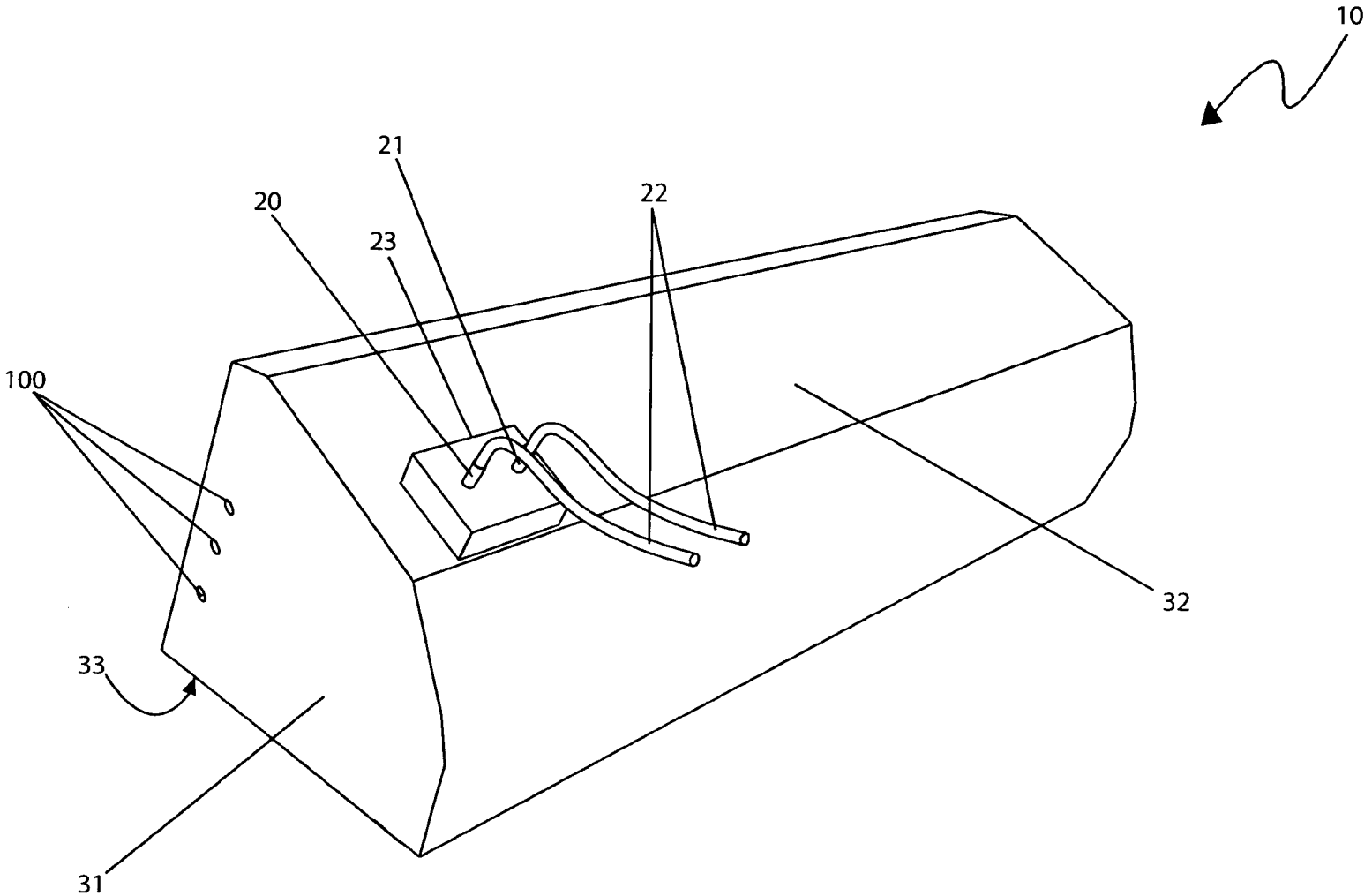
FIG. 2*b* is a rear perspective view of the anti-freeze backhoe bucket insert 10, according to a preferred embodiment of the present invention.
Figure 3:
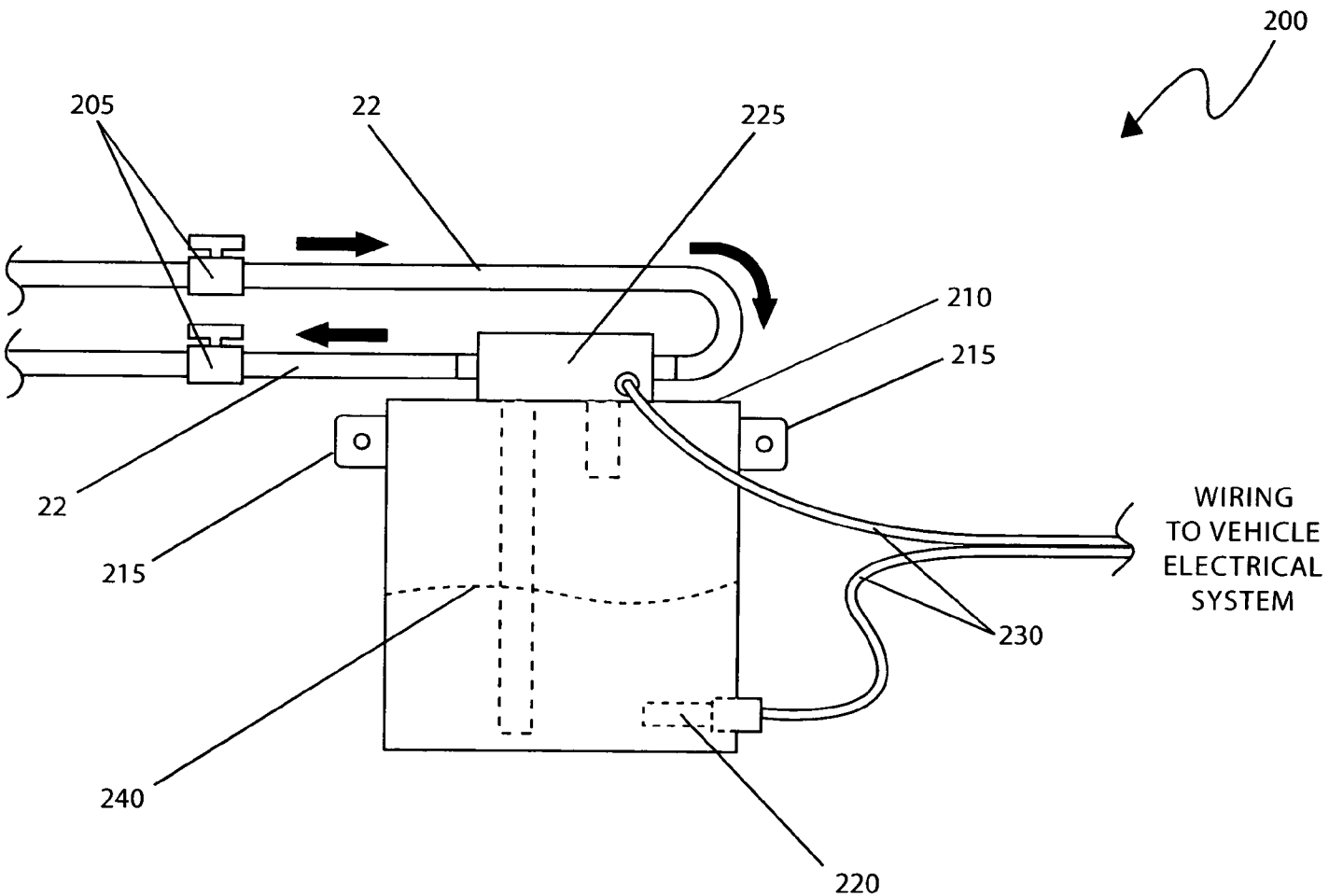
FIG. 3 is a diagram of a pumping system 200 portion of the anti-freeze backhoe bucket insert 10, according to an alternate embodiment of the present invention.
Figure 4A:
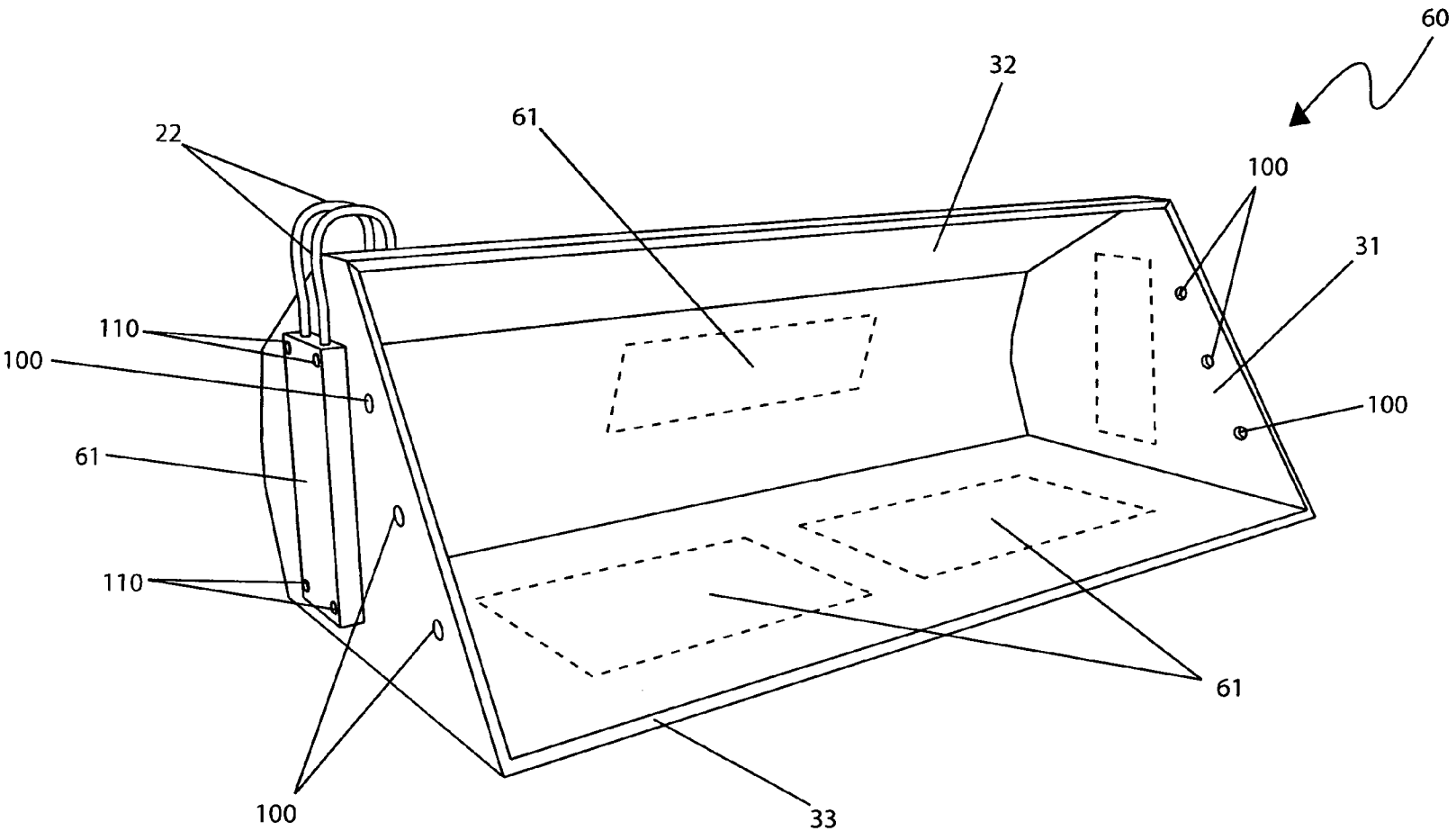
FIG. 4*a* is a front perspective view of the anti-freeze backhoe bucket insert 10 depicting external heating plate embodiment 60, according to an alternate embodiment of the present invention.
Figure 4B:
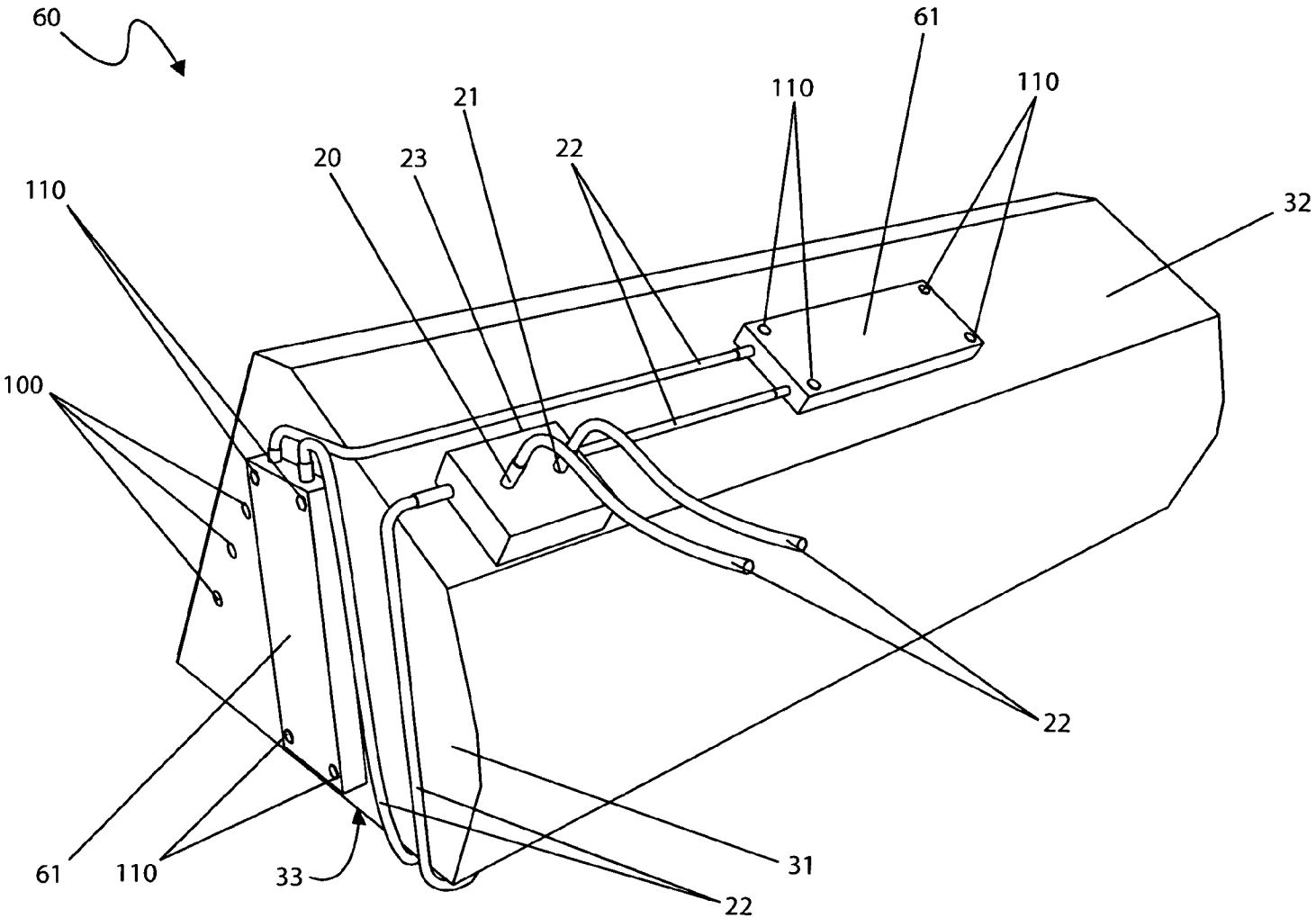
FIG. 4*b* is a rear perspective view of the anti-freeze backhoe bucket insert 10 depicting an external cooling plate embodiment 60, according to an alternate embodiment of the present invention; and, FIG. 5 is a front perspective view of the anti-freeze backhoe bucket insert 10, depicting an internal cooling port embodiment 45, according to an alternate embodiment of the present invention.
Figure 5:
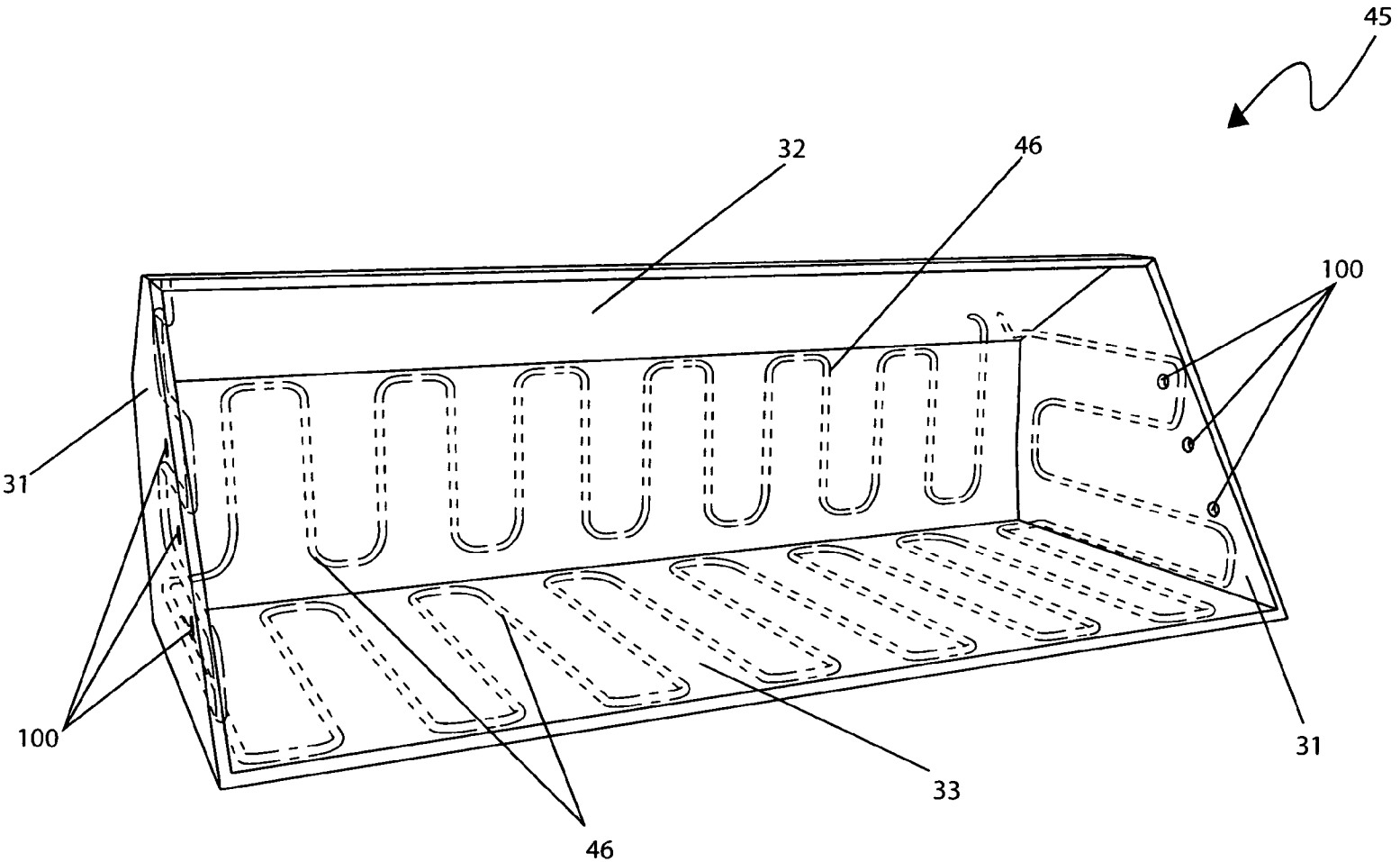

The best mode for carrying out the invention is presented in terms of its preferred embodiment, herein depicted within FIGS. 1 through 3, and its alternate embodiments as depicted in FIGS. 4*a* through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an anti-freeze backhoe bucket insert (herein described as the "apparatus") 10, which provides a means for a steel insert apparatus 10 for a backhoe bucket 50 having an integral heating system to defrost construction equipment in cold weather. The apparatus 10 is intended for use on backhoes, front end loaders, bulldozers, and other similar equipment with a blade or a bucket 50. When required by cold weather, a conventional blade or bucket 50 will have the apparatus 10 inserted snuggly into the bucket 50. The apparatus 10 contains a series of interconnected heating tubes 40 along its inner surfaces. The heating tubes 40 are connected to a mounting block 23 comprising input 20 and output 21 connections on each end which allow engine coolant fluid 240 to be circulated through the heating tubes 40 by means of flexible hoses 22 and fittings providing heat to the apparatus 10, thereby reducing ice or snow build-up.

Referring now to FIG. 1, an environmental view of the apparatus 10, according to the preferred embodiment of the present invention, is disclosed. For illustration sake, the apparatus 10 is depicted here taking a form which corresponds to that of a common backhoe bucket; however, it should be noted that the apparatus 10 may be configured and adapted to take on a variety of different custom forms using a casting or other fabrication process for applications such as front end loaders, bulldozers, and other similar equipment which incorporate working implements such as blades, buckets, and the like and as such should not be interpreted as a limiting factor of the invention 10.

The apparatus 10 comprises a pair of side panels 31, a back panel 32, a floor panel 33, a plurality of heating tubes 40, a pair of bucket penetrations 25, a plurality of attachments 100, and a plurality of fasteners 110. The apparatus 10 is envisioned to take the form the bucket 50 inserted and fitted snuggly therein said bucket 50 being attachable to an arm of a backhoe. The apparatus 10 is sized proportionally smaller and similarly shaped to a conventional bucket 50 and is to be inserted therewithin said bucket 50 and attached using preferably a plurality of threaded attachment holes 100 and fasteners 110 preferably along the side panels 31; however, any number of attachment points and respective hardware 110 may be provided without deviating from the basic concept and as such should not be interpreted as a limiting factor of the present invention 10. Further securement therewithin a designated bucket 50 to the apparatus 10 rim and the inside edges may incorporate a welding process to prevent movement of the apparatus 10 during operation. It will be appreciated that other alternate securement means of the apparatus 10 therewithin a bucket 50 may be utilized in combination with fasteners, welding, or the like and as such should not be interpreted as a limiting factor of the present invention 10.

The apparatus 10 comprises a curvilinear back wall 32, two (2) symmetrically vertical side walls 31, and a floor 33 designed specifically to fit snugly inside a bucket 50 such that the back wall 32 of the apparatus 10 abuts thereagainst the back wall of the designated bucket 50, the side walls 31 of the apparatus 10 abuts thereagainst the corresponding side walls of the designated bucket 50, and the floor 33 of the apparatus 10 abuts thereagainst the corresponding floor of the designated bucket 50.

The plurality of heating tubes 40 are affixed to inner surfaces of the apparatus 10 forming a singular fluid path in a serpentine manner. Said heating tubes 40 further comprise an inlet 20 and outlet 21 tube envisioned to be located at a rear upper right-hand position (see FIGS. 2*a* and 2*b*). The bucket 50 comprises particular modifications comprising a pair of drilled penetrations 25 which provide alignment and circular clearance to said connection tubes 20, 21 and associated fluid hoses 22 projecting therethrough.

Referring now to FIGS. 2*a* and 2*b*, front and rear perspective views of the apparatus 10, according to the preferred embodiment of the present invention, are disclosed. The apparatus 10 comprises a pair of side panels 31, a back panel 32, a floor panel 33, a plurality of heating tubes 40, and a plurality of attachments 100. An inlet tube 20 provides a flow of heated fluid 240 thereto a series of heating tubes 40 to defrost the apparatus 10. The inlet tube 20 defines an interior conduit having a fluid dispersing end residing in fluid communication with an open front face of the heating tubes 40 to provide the flow of said fluid 240. The inlet tube 20 protrudes outwardly therefrom the bucket 50 and in fluid communication with a pumping system 200 (see FIG. 3). The pumping system 200 will propel the heated fluid 240 therethrough the inlet tube 20 and the heating tubes 40 in fluid communication therewith. The fluid 240 is subsequently impelled in a series of upward and downward directions therethrough the heating tubes 40 thereby enabling the fluid 240 to progress therethrough in sufficient time. An outlet tube 21 will return the fluid 240 back to the pumping system 200 reservoir to be reheated for subsequent reuse (see FIG. 3).

The heating tubes 40 are envisioned to be a singular and continuous fluid transportation member in a serpentine configuration having straight segments spanning across the core of the apparatus 10 with a plurality of peaks and dips in proximity thereto the rim of said apparatus 10. The heating tubes 40 preferably span across a substantial portion of the back wall 32, side walls 31, and floor 33 of the apparatus 10 providing optimum heat distribution. The heating tubes 40 are envisioned to be durable steel conduit with a flexible spring guard enveloping thereupon for preventing wearing and damage to said heating tubes 40 and secured to the exterior surface of the core of the apparatus 10 by conventional securement means such as welding, bolting, fastening, or other securement means.

The heating tubes 40 have a preferably uniform inner diameter defining a continuous conduit with a first and second end portion; the first end portion being in communication with the inlet tube 20 and the second end portion being in fluid communication with the outlet tube 21; and consequently in fluid communication with the pumping system 200. The inlet tube 20 and the outlet tube 21 comprise a threaded connector to a mounting block 23 which provides secure attachment thereupon a rear upper surface of the apparatus 10. Said mounting block 23 is positioned specifically to provide alignment of the inlet 20 and outlet 21 tube portions of the apparatus 10 with the aforementioned pre-drilled bucket penetrations 25.

Referring now to FIG. 3, a diagram of a pumping system 200 portion of the apparatus 10, according to the preferred embodiment of the present invention, is disclosed. The pumping system 200 comprises a pair of fluid hoses 22, a pair of control valves 205, a pump 225, a reservoir 210, a heating coil 220, and a power cord 230. The pumping system 200 is depicted here as a stand-alone fluid heating 220 and recirculation 225 system; however, those familiar with the art will appreciate that connection of the fluid hose portion 22 of the apparatus 10 directly to an existing cooling system of a backhoe may be utilized to provide heated circulating fluid 240 in lieu of the pumping system 200 with equal benefit, and as such should not be interpreted as a limiting factor of the present invention 10.

The fluid hoses 22 transport the fluid 240 to and from the pumping system 200 and are envisioned to comprise standard automotive heater hose common in the industry. The fluid hoses 22 comprise a pair of in-line control valves 205 providing a flow control and isolation means to the pumping system 200 for purposes of controlling temperature as well as enabling repair, maintenance, and disassembly of the entire fluid system. The control valves 205 are envisioned to be common gate or ball-type valves made of rugged corrosion resistant materials such as brass, stainless steel, or the like. The pump 225 is envisioned to be in fluid communication with the fluid hoses 22 via inlet and outlet fittings thereupon said pump 225. The pump 225 is envisioned to be a miniature 12-volt unit common in the automotive industry. The pump 225 is envisioned to comprise an integral round or rectangular reservoir 210 having a capacity of one (1) to two (2) gallons being sufficient to providing heated fluid 240 to the apparatus 10. The reservoir 210 is envisioned to be made using an assembly of welded steel plates to hold the heating fluid 240 envisioned to be ethylene glycol or equivalent heating/cooling solution. The reservoir 210 comprises two (2) or more integral mounting brackets 215 providing an attachment means to a backhoe body panel portion.

The reservoir 210 comprises an internal submerged heating coil 220 which provides a heating means to the fluid 240 therein. The heating coil 20 is envisioned to be a 12-volt commercially available unit similar to those used in motor homes and other recreational vehicles. Electrical power is provided to both the pump 225 and the heating coil 220 via a power cord 230 which is wired thereinto an existing vehicle electrical system in an expected manner. The entire pumping system 200 is envisioned to be a recycled closed loop type. The pumping system 200 is envisioned to provide all necessary fittings, clamps, and other plumbing components and supplies normally required for assembly of the apparatus 10.

Referring now to FIGS. 4*a* and 4*b*, front and rear perspective views of the apparatus 10 depicting an external heating plate embodiment 60, according to an alternate embodiment of the present invention, are disclosed. The apparatus 10 is illustrated here utilizing a plurality of external heating plates 61. The cooling plates 61 comprise attachment features 100 therein so as to be in intimate contact with the aforementioned panels 31, 32, 33 of the apparatus 10, thereby providing effective conduction of heat from fluid 240 circulating therein. The heating plates 61 comprise preferably of welded parallel steel plates further comprising internal sealed fluid ports in a serpentine or other pattern. The heating plates 61 are bolted thereto using a plurality of fasteners 110 threadingly engaging pre-drilled holes 100 therein said bucket 50, thereby providing effective conduction of heat from said fluid 240 through outer walls of said heating plates 61 and subsequently thereinto the panels 31, 32, 33 of the apparatus 10. The heating plates 61 are envisioned to be in fluid communication with one another via interconnected fluid hoses 22 forming a continuous conduit and being in further fluid communication with the pumping system 200 in a similar manner as the preferred embodiment of the invention 10. Said heating plates 61 are further envisioned to be provided in a variety of rectangular, round, and other shapes being customizable to particular bucket panels 50 as required.

Referring now to FIG. 5, a front perspective view of the apparatus 10 depicting an internal cooling port embodiment 45, according to an alternate embodiment of the present invention, is disclosed. The apparatus 10 is illustrated here comprising internal fluid circulation means via a series of internally integral heating ports 46, thereby providing additional protection and improved thermodynamic properties to the apparatus 10. The heating ports 46 are envisioned to be formed therein the apparatus 10 using a casting process providing similar serpentine patterns, inlet 20 and outlet 21 tubes, and fluid dynamic properties similar to the preferred embodiment of the invention 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: inserting the apparatus 10 therewithin a designated backhoe bucket 50 such that the corresponding walls 31, 32 and floors 33 of the apparatus 10 and bucket 50 are abutted thereagainst one another; securing the apparatus 10 therewithin said bucket 50 core using preferably bolting or other securement means such as welding; mounting the reservoir 210 and pump 225 combination thereto a desired body panel of the backhoe 50 using the reservoir mounts 215 and provided fasteners 110; wiring the pumping system 200 thereto the vehicle 12-volt electrical system; attaching fluid hose 22 thereto the inlet 20 and outlet 21 tubes; routing said fluid hose 22 as required from the inlet 20 and outlet 21 tubes to corresponding inlet/outlet ports thereupon the pump 225; and, utilizing said pumping system 200 to propel the heated fluid 240 through the fluid hose 22 from the reservoir 210 therethrough the inlet tube 20, the heating tubes 40, the outlet tube 21, and back through the fluid hose 22 to the pumping system 200 to be reheated using the heating coil 220, and recycled using the pump 225.

The apparatus 10 is envisioned to utilize heated fluid 240 obtained from the reservoir to be recycled therethrough an inlet tube 20 into a series of heating tubes 40. The heating tubes 40 progress the heated fluid 240 thereby heating the core of the apparatus 10. The apparatus 10 prevents mud and water from freezing during operation thereby reducing the accumulation of mud, ice, or other obstructions from sticking to the apparatus 10. The fluid then progresses therethrough the outlet tube 21 back to the reservoir 210 to be reheated for reuse.

The method of installing and utilizing the alternate embodiment of the apparatus 10 incorporating external heating plates 60 may be achieved by performing the following additional steps: specifying and procuring all desired heating plates 61 in shapes and sizes which correspond to a backhoe bucket 50 shape; drilling and tapping a plurality of mounting holes therein the bucket 50; mounting a desired number of heating plates 61 thereon exterior flat surfaces of the bucket 50 using fasteners 100 and conductive anti-corrosion agents between said heating plate 61 and the bucket surface 50 such as a thermal grease, or the like; inter-connecting the heating plates 61 to form a continuous conduit using a plurality of fluid hoses 22; connecting inlet and outlet ends of said fluid hoses 22 to the mounting block 23; routing the fluid hoses 22 to the reservoir 210 in similar fashion as the preferred embodiment of the invention 10.

The method of installing and utilizing the alternate embodiment of the apparatus 10 incorporating internal heating ports 46 may be achieved in an identical fashion as to those of the preferred embodiment of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An anti-freeze backhoe bucket apparatus for defrosting construction equipment in cold weather, said anti-freeze backhoe bucket apparatus comprising:

a housing seated within an existing bucket of the construction equipment;

a plurality of heating elements seated within said housing;

a pumping system including a plurality of fluid hoses coupled thereto, said pumping system supplying a volume of heating fluid to said heating elements; and, inlet and outlet hoses in fluid communication with said fluid hoses and said heating elements respectively;

wherein said inlet and outlet hoses cooperating with said pumping system to thereby introduce heated fluid into said heating elements and subsequently directing cooled fluid from said heating elements back to said pumping system to be reheated.

2. The anti-freeze backhoe bucket apparatus of claim 1, wherein said heating elements are affixed to inner surfaces of said housing to thereby form a singular fluid path in a serpentine pattern.

3. The anti-freeze backhoe bucket apparatus of claim 1, wherein said housing comprises:

monolithically formed sidewalls, a back wall and a floor;

wherein said heating elements have a singular and continuous body provided with a serpentine configuration having straight segments spanning across a core of said housing and further having a plurality of peaks and dips in proximity to a rim of said housing.

4. The anti-freeze backhoe bucket apparatus of claim 1, wherein said heating elements span across a substantial portion of said back wall, said side walls, and said floor of said housing for providing optimum heat distribution, said heating elements being formed from non-corrosive and durable material.

5. The anti-freeze backhoe bucket apparatus of claim 1, wherein said pumping system comprises:

a pair of control valves coupled directly to said fluid hoses for controlling a flow rate of the heated and cooled fluids respectively;

a pump attached to said fluid hoses;

a reservoir in fluid communication with said pump; and, a heating coil seated within said reservoir.

6. The anti-freeze backhoe bucket apparatus of claim 1, wherein said heating elements are selected from a group of heating elements comprising: a plurality of heating tubes, a plurality of interconnected heating plates, a plurality of heating ports embedded within said housing and any combination thereof.

7. An anti-freeze backhoe bucket apparatus for defrosting construction equipment in cold weather, said anti-freeze backhoe bucket apparatus comprising:

a housing removably seated within an existing bucket of the construction equipment;

a plurality of heating elements seated within said housing;

a closed loop pumping system including a plurality of fluid hoses coupled thereto, said pumping system supplying a volume of heating fluid to said heating elements; and, inlet and outlet hoses in fluid communication with said fluid hoses and said heating elements respectively;

wherein said inlet and outlet hoses cooperating with said pumping system to thereby introduce heated fluid into said heating elements and subsequently directing cooled fluid from said heating elements back to said pumping system to be reheated.

8. The anti-freeze backhoe bucket apparatus of claim 7, wherein said heating elements are affixed to inner surfaces of said housing to thereby form a singular fluid path in a serpentine pattern.

9. The anti-freeze backhoe bucket apparatus of claim 7, wherein said housing comprises:

monolithically formed sidewalls, a back wall and a floor;

wherein said heating elements have a singular and continuous body provided with a serpentine configuration having straight segments spanning across a core of said housing and further having a plurality of peaks and dips in proximity to a rim of said housing.

10. The anti-freeze backhoe bucket apparatus of claim 7, wherein said heating elements span across a substantial portion of said back wall, said side walls, and said floor of said housing for providing optimum heat distribution, said heating elements being formed from non-corrosive and durable material.

11. The anti-freeze backhoe bucket apparatus of claim 7, wherein said pumping system comprises:

a pair of control valves coupled directly to said fluid hoses for controlling a flow rate of the heated and cooled fluids respectively;

a pump attached to said fluid hoses;

a reservoir in fluid communication with said pump; and, a heating coil seated within said reservoir.

12. The anti-freeze backhoe bucket apparatus of claim 7, wherein said heating elements are selected from a group of heating elements comprising: a plurality of heating tubes, a plurality of interconnected heating plates, a plurality of heating ports embedded within said housing and any combination thereof.

13. A method for heating a bucket of an existing construction equipment machine, said method comprising the steps of:

a. inserting a housing within the bucket such that corresponding walls and floors of the housing and bucket are abutted against one another respectively;

b. fastening the housing within the bucket;

c. positioning at least one heating element within said housing;

d. mounting a pumping system to a desired body panel of the bucket;

e. wiring the pumping system to an existing vehicle electrical system;

f. attaching the heating elements to inlet and outlet tubes exiting from the housing;

g. attaching fluid hoses to the inlet and outlet tubes respectively;

h. routing said fluid hoses from the inlet and outlet 21 tubes to corresponding ports of the pump system; and, i. propelling heated fluid from the pumping system through the fluid hoses and the inlet tube and through the heating elements such that cooled fluid is channeled out from the outlet tube and back through the outlet tube and the fluid hoses to the pumping system to be reheated using the pumping system.

* * * * *